US007169994B1

(12) United States Patent
Payerl

(10) Patent No.: US 7,169,994 B1
(45) Date of Patent: Jan. 30, 2007

(54) MUSICAL RHYTHM INSTRUMENT

(75) Inventor: Wolfgang Payerl, Münchsteinach (DE)

(73) Assignee: Roland Meinl Musikinstrumente GmbH & Co. KG, Neustadt/Aisch (DE)

( * ) Notice: Subject to any disclaimer, the term of this patent is extended or adjusted under 35 U.S.C. 154(b) by 0 days.

(21) Appl. No.: 11/258,135

(22) Filed: Oct. 26, 2005

(30) Foreign Application Priority Data

Aug. 9, 2005 (DE) ..... 10 2005 037 450

(51) Int. Cl.
*G10D 13/02* (2006.01)

(52) U.S. Cl. ..... 84/402

(58) Field of Classification Search ..... 84/402–404
See application file for complete search history.

(56) References Cited

U.S. PATENT DOCUMENTS 5,808,215 A * 9/1998 Kralik et al. ..... 84/402
6,362,406 B1 * 3/2002 Enhoffer et al. ..... 84/402
6,363,406 B1 * 3/2002 Takano et al. ..... 708/319

FOREIGN PATENT DOCUMENTS

DE 200 06 964 U1 9/2000
DE 10 2005 032 775.3 7/2005

* cited by examiner

*Primary Examiner*—Kimberly Lockett
(74) *Attorney, Agent, or Firm*—Browdy and Neimark, PLLC

(57) ABSTRACT

A musical rhythm instrument comprising a hand-held hollow body having at least one opening and a plurality of particles in the interior of the hollow body, which, when the hollow body is moved rhythmically, impact upon its inner wall and create a sound, is provided with a hollow body incorporating a plurality of openings distributed over its surface and has a basic shape such that it can be largely encompassed by a hand that is holding it.

7 Claims, 1 Drawing Sheet

MUSICAL RHYTHM INSTRUMENT

FIELD OF THE INVENTION

The invention concerns a musical rhythm instrument comprising a hand-held main body having at least one opening and a plurality of particles in the interior of the main body, which, when the main body is moved rhythmically, impact upon its inner wall, creating a sound.

BACKGROUND OF THE INVENTION

A musical instrument of the generic type is known from DE 200 06 964 U1. The known musical instrument has a cylindrical, comparatively large main body, with an opening formed at one face end, which permits the sound to be varied by covering this opening with the thumb. The main body is largely not enclosed when held in a person's hand.

On the other hand, musical rhythm instruments referred to as shakers are known in the form of one or more combined egg-shaped housings which, due to their shape, are adapted to the ergonomics of the human hand and are largely enclosed by same.

The known musical instruments of this type, as they are known, for example, from DE 10 2005 032 775.3, have a closed surface, with a variation of the sound being possible in such a way that the longitudinal axis is inclined to a greater or lesser degree while shaking the instrument.

SUMMARY OF THE INVENTION

Proceeding from this, the invention has as its object to improve a musical instrument of the generic type in such a way that new and particularly also variable sound effects are attainable.

This object is met according to the invention in such a way that the main body incorporates a plurality of openings distributed over its surface and has a basic shape such that it can be largely enclosed by a hand that is holding it.

The inventive design permits a plurality of openings of this type to be fully or partially released or closed simultaneously by closing or opening one's hand.

In a particularly advantageous design, provision is made for each opening to be surrounded by an upwardly outwardly projecting rim. In this manner a sharp sealing lip is created around each opening, rendering the variable sound effect of the opening and closing relative to the covering hand particularly pronounced. At the same time this increases the surface roughness and facilitates holding the instrument. Lastly, a certain clearance is created between the closed surface of the main body and the hand, so that sweating of the hand is not promoted.

The main body preferably has a rounded, approximately egg-shaped basic shape. This type of basic shape is already known per se, however, in conjunction with the openings provided according to the invention, it is of particular importance that the shape is adapted to the ergonomics of the hand and that it can be largely enclosed by the hand.

The main body may advantageously consist of two joinable halves, in particular identical halves. This permits an easy filling with particles and the production is rendered more economical since only one single injection mold is required for the upper and lower half of the assembled state.

Provision may additionally be made for the halves to be rotatable relative to each other, for example in such a way that they are locked into one another by means of an annular groove and annular bead, which, in connection with guide baffles disposed in the main body for the particles permits new options for sound creation.

A particularly good sound is obtained in such a way that the openings are formed as rows extending in the longitudinal direction or axial direction of the main body.

The invention will be described in more detail below based on a preferred example embodiment in conjunction with the drawings.

DESCRIPTION OF THE PREFERRED EMBODIMENT

Figure 1:
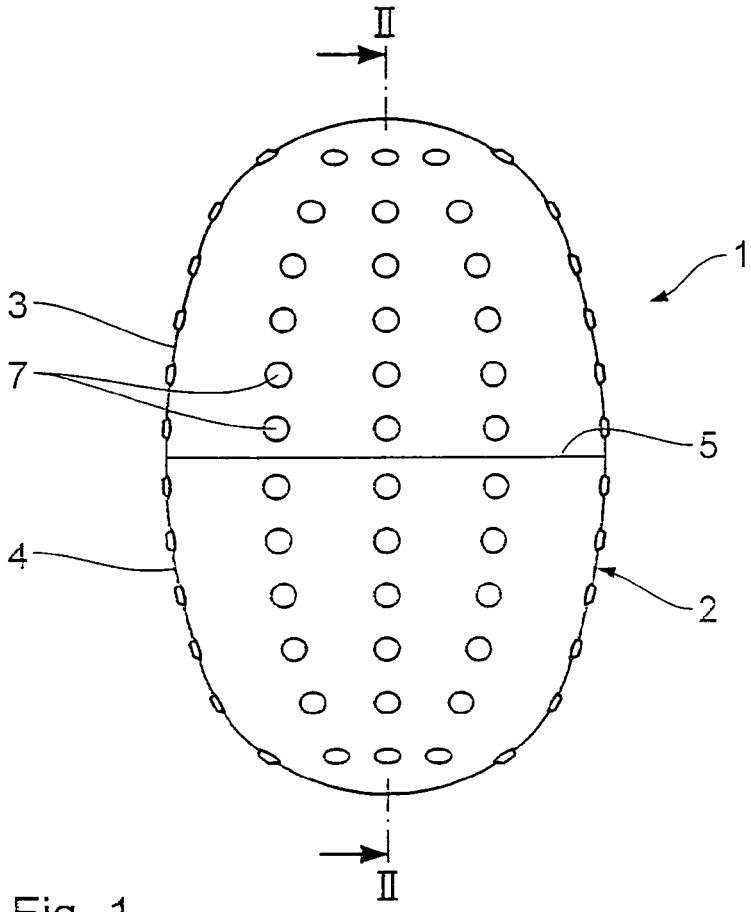
FIG. 1 shows a view of the inventive musical rhythm instrument.
Figure 2:
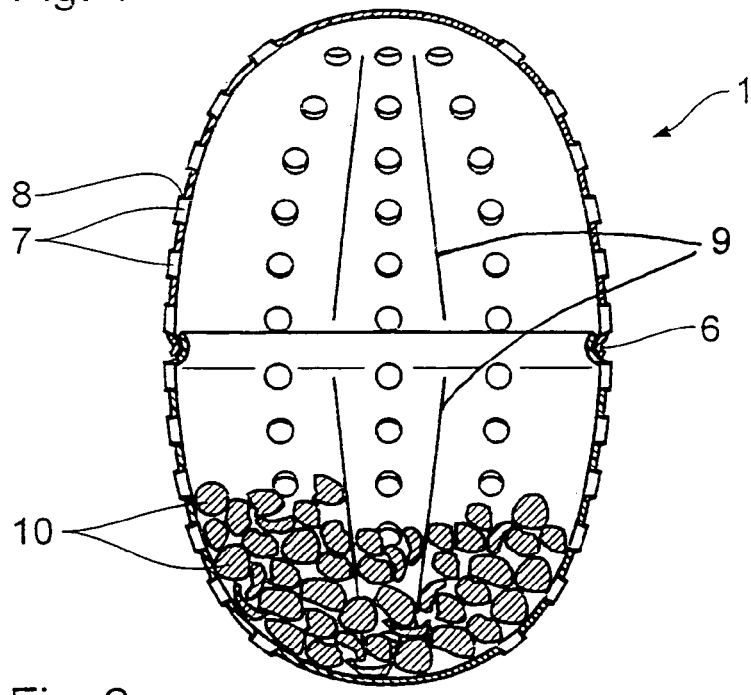
FIG. 2 shows a longitudinal section of the musical rhythm instrument.

A musical rhythm instrument 1 shown in the drawing has an approximately egg-shaped main body 2 comprising two halves 3, 4 that are identical to one another and lockable into one another along a separation line 5 by means of an annular bead and annular groove 6.

The main body 2 is provided with a plurality of openings 7 that are arranged in rows and extend in the axial direction.

Each opening 7 has an upwardly outwardly projecting rim.

Disposed in the interior of the main body 2 are baffles 9 that serve to guide particles 10 when the main body 2 is shaken, and to thereby influence the sound.

What is claimed is:

1. A musical rhythm instrument comprising a hand-held main body having at least one opening and a plurality of particles in the interior of the main body, which, when the main body is moved rhythmically, impact upon an inner wall of the main body creating a sound, wherein the main body (2) incorporates a plurality of openings (7) distributed over the surface thereof and has a basic shape that can be largely encompassed by a holding hand;

wherein said openings are arranged such that said holding hand can at least partially open or close said openings to vary the sound effect of the instrument, and wherein each opening is surrounded by an upwardly outwardly projecting rim, wherein the rims are made of the same material as the main body.

2. A musical rhythm instrument according to claim 1, wherein the main body (2) has a rounded, approximately egg-shaped basic shape.

3. A musical rhythm instrument according to claim 1, wherein the main body (2) consists of two halves (3, 4) that are joinable to one another.

4. A musical rhythm instrument according to claim 3, wherein the halves (3, 4) are rotatable relative to each other.

5. A musical rhythm instrument according to claim 4, wherein guide baffles (9) are disposed in the interior of the main body (2) so that by rotating the halves (3, 4) of the main body (2) relative to each other, the position of the guide baffles (9) and, hence, the sound is variable.

6. A musical rhythm instrument according to claim 1, wherein the openings (7) are arranged in rows that extend in the axial direction of the main body (2).

7. A musical rhythm instrument according to claim 1, wherein the rims are formed as a unit with the main body.

* * * * *